US006994176B2

(12) United States Patent
Shahin et al.

(10) Patent No.: US 6,994,176 B2
(45) Date of Patent: Feb. 7, 2006

(54) ADJUSTABLE ROTATING GUIDES FOR SPIDER OR ELEVATOR

(75) Inventors: David Shahin, Houston, TX (US); Karsten Heidecke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 12 days.

(21) Appl. No.: 10/794,800

(22) Filed: Mar. 5, 2004

(65) Prior Publication Data

US 2004/0251055 A1 Dec. 16, 2004

Related U.S. Application Data

(63) Continuation-in-part of application No. 10/207,542, filed on Jul. 29, 2002.

(60) Provisional application No. 60/452,154, filed on Mar. 5, 2003.

(51) Int. Cl.
*E21B 19/10* (2006.01)

(52) U.S. Cl. ..... 175/423; 166/75.16; 166/77.52

(58) Field of Classification Search ..... 175/423; 166/88.2, 78.1, 75.16, 77.52
See application file for complete search history.

(56) References Cited

U.S. PATENT DOCUMENTS

| | | | |
|---|---|---|---|
| 1,185,582 | A | 5/1916 | Bignell |
| 1,301,285 | A | 4/1919 | Leonard |
| 1,342,424 | A | 6/1920 | Cotten |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 2,017,451 | A | 10/1935 | Wickersham |
| 2,049,450 | A | 8/1936 | Johnson |
| 2,060,352 | A | 11/1936 | Stokes |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,610,690 | A | 9/1952 | Beatty |

(Continued)

FOREIGN PATENT DOCUMENTS

CA 2 335 192 11/2001

(Continued)

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

(Continued)

*Primary Examiner*—William Neuder
(74) *Attorney, Agent, or Firm*—Patterson & Sheridan, LLP

(57) ABSTRACT

The present invention provides a method and apparatus for gripping one or more tubulars, which may include casing, during a tubular handling operation, drilling operation, and/or drilling with casing operation. The gripping apparatus comprises a housing having a bore extending therethrough and one or more gripping members which extend radially within the bore to grippingly engage a tubular or casing when activated. Adjustable guides attached to a portion of the gripping apparatus facilitate rotational movement of the casing during the drilling operation when the gripping members of the gripping apparatus are deactivated.

32 Claims, 3 Drawing Sheets

U.S. PATENT DOCUMENTS

| | | | |
|---|---|---|---|
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,846 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Welner |
| 3,624,760 | A | 11/1971 | Bodine |
| 3,635,105 | A | 1/1972 | Dickmann et al. |
| 3,656,564 | A | 4/1972 | Brown |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,747,675 | A | 7/1973 | Brown |
| 3,760,894 | A | 9/1973 | Pitifer |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,934,660 | A | 1/1976 | Nelson |
| 3,945,444 | A | 3/1976 | Knudson |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |
| 4,194,383 | A | 3/1980 | Huzyak |
| 4,221,269 | A | 9/1980 | Hudson |
| 4,227,197 | A | 10/1980 | Nimmo et al. |
| 4,241,878 | A | 12/1980 | Underwood |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,277,197 | A | 7/1981 | Bingham |
| 4,280,380 | A | 7/1981 | Eshghy |
| 4,281,722 | A | 8/1981 | Tucker et al. |
| 4,287,949 | A | 9/1981 | Lindsey, Jr. |
| 4,311,195 | A | 1/1982 | Mullins, II |
| 4,315,553 | A | 2/1982 | Stallings |
| 4,320,915 | A | 3/1982 | Abbott et al. |
| 4,336,415 | A | 6/1982 | Walling |
| 4,384,627 | A | 5/1983 | Ramirez-Jauregui |
| 4,392,534 | A | 7/1983 | Miida |
| 4,396,076 | A | 8/1983 | Inoue |
| 4,396,077 | A | 8/1983 | Radtke |
| 4,407,378 | A | 10/1983 | Thomas |
| 4,408,669 | A | 10/1983 | Wiredal |
| 4,413,682 | A | 11/1983 | Callihan et al. |
| 4,427,063 | A | 1/1984 | Skinner |
| 4,437,363 | A | 3/1984 | Haynes |
| 4,440,220 | A | 4/1984 | McArthur |
| 4,445,734 | A | 5/1984 | Cunningham |
| 4,446,745 | A | 5/1984 | Stone et al. |
| 4,449,596 | A | 5/1984 | Boyadjieff |
| 4,460,053 | A | 7/1984 | Jurgens et al. |
| 4,463,814 | A | 8/1984 | Horstmeyer et al. |
| 4,466,498 | A | 8/1984 | Bardwell |
| 4,470,470 | A | 9/1984 | Takano |
| 4,472,002 | A | 9/1984 | Beney et al. |
| 4,474,243 | A | 10/1984 | Gaines |
| 4,483,399 | A | 11/1984 | Colgate |
| 4,489,793 | A | 12/1984 | Boren |
| 4,494,424 | A | 1/1985 | Bates |
| 4,515,045 | A | 5/1985 | Gnatchenko et al. |
| 4,529,045 | A | 7/1985 | Boyadjieff et al. |

4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,312 A 6/1987 Mosing et al.
4,681,158 A 7/1987 Pennison
4,683,962 A 8/1987 True
4,686,873 A 8/1987 Lang et al.
4,691,587 A 9/1987 Farrand et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,901,069 A 2/1990 Veneruso
4,904,119 A 2/1990 Legendre et al.
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,069,297 A 12/1991 Krueger
5,074,366 A 12/1991 Karlsson et al.
5,082,069 A 1/1992 Seiler et al.
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,458,209 A 10/1995 Hayes et al.
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.

5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,546,317 A 8/1996 Andrieu
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,575,344 A 11/1996 Wireman
5,577,566 A 11/1996 Albright et al.
5,582,259 A 12/1996 Barr
5,584,343 A 12/1996 Coone
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,791,410 A 8/1998 Castille et al.
5,803,191 A 9/1998 Mackintosh
5,803,666 A 9/1998 Keller
5,813,456 A 9/1998 Milner et al.
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,957,225 A 9/1999 Sinor
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 * 5/2001 Terral ..... 294/102.2
6,234,257 B1 5/2001 Ciglenec et al.
6,237,684 B1 5/2001 Bouligny, Jr. et al.
6,263,987 B1 7/2001 Vail, III
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,433,241 B2 8/2002 Wu et al.

6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,543,552 B1 4/2003 Metcalfe et al.
6,547,017 B1 4/2003 Vail, III
6,554,064 B1 4/2003 Restarick et al.
6,585,040 B2 7/2003 Hanton et al.
6,591,471 B1 7/2003 Hollingsworth et al.
6,622,796 B1 9/2003 Pietras
6,634,430 B2 10/2003 Dawson et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,688,394 B1 2/2004 Ayling
6,691,801 B2 2/2004 Juhasz et al.
6,698,595 B2 3/2004 Norell et al.
6,702,040 B1 3/2004 Sensenig
6,708,769 B2 3/2004 Haugen et al.
6,725,924 B2 4/2004 Davidson et al.
6,725,938 B1 4/2004 Pietras
6,742,596 B2 6/2004 Haugen
6,742,606 B2 6/2004 Metcalfe et al.
6,745,834 B2 6/2004 Davis et al.
6,752,211 B2 6/2004 Dewey et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0173090 A1 9/2003 Cook et al.
2003/0213598 A1 11/2003 Hughes
2003/0217865 A1 11/2003 Simpson et al.
2003/0221519 A1 12/2003 Haugen et al.
2004/0000405 A1 1/2004 Fournier, Jr. et al.
2004/0003490 A1 1/2004 Shahin et al.
2004/0003944 A1 1/2004 Vincent et al.
2004/0011534 A1 1/2004 Simonds et al.
2004/0016575 A1 * 1/2004 Shahin et al. ..... 175/423
2004/0060697 A1 4/2004 Tilton et al.
2004/0069500 A1 4/2004 Haugen
2004/0069501 A1 4/2004 Haugen et al.
2004/0079533 A1 4/2004 Buytaert et al.
2004/0108142 A1 6/2004 Vail, III
2004/0112603 A1 6/2004 Galloway et al.
2004/0112646 A1 6/2004 Vail
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0173358 A1 9/2004 Haugen
2004/0216892 A1 11/2004 Giroux et al.
2004/0216924 A1 11/2004 Pietras et al.
2004/0216925 A1 11/2004 Metcalfe et al.
2004/0221997 A1 11/2004 Giroux et al.
2004/0226751 A1 11/2004 McKay et al.
2004/0244992 A1 12/2004 Carter et al.
2004/0245020 A1 12/2004 Giroux et al.
2004/0251025 A1 12/2004 Giroux et al.
2004/0251050 A1 12/2004 Shahin et al.
2004/0251055 A1 12/2004 Shahin et al.
2004/0262013 A1 12/2004 Tilton et al.
2005/0000691 A1 1/2005 Gilroux et al.

FOREIGN PATENT DOCUMENTS

DE 3 213 464 10/1983
DE 3 523 221 2/1987
DE 3 918 132 12/1989
DE 4 133 802 10/1992
EP 0 087 373 8/1983
EP 0 162 000 11/1985
EP 0 171 144 2/1986
EP 0 235 105 9/1987
EP 0 265 344 4/1988
EP 0 285 386 10/1988
EP 0 426 123 5/1991
EP 0 462 618 12/1991
EP 0 474 481 3/1992
EP 0474481 * 3/1992
EP 0479583 4/1992
EP 0 525 247 2/1993
EP 0 554 568 8/1993
EP 0 589 823 3/1994
EP 0 659 975 6/1995
EP 0 790 386 8/1997
EP 0 881 354 4/1998
EP 0 571 045 8/1998
EP 0 961 007 12/1999
EP 0 962 384 12/1999
EP 1 006 260 6/2000
EP 1 050 661 11/2000
EP 1148206 10/2001
EP 1 256 691 11/2002
FR 2053088 7/1970
FR 2741907 6/1997
FR 2 841 293 12/2003
GB 540 027 10/1941
GB 709 365 5/1954
GB 716 761 10/1954

| | | |
|---|---|---|
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 201 912 | 9/1988 |
| GB | 2 216 926 | 10/1989 |
| GB | 2 224 481 | 9/1990 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 333 542 | 7/1999 |
| GB | 2 335 217 | 9/1999 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 765 | 9/2002 |
| GB | 2 382 361 | 5/2003 |
| GB | 2381809 | 5/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | * 11/1999 |
| WO | WO 99/64713 | 12/1999 |
| WO | WO 00/05483 | 2/2000 |
| WO | WO 00/08293 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/44601 | 6/2002 |
| WO | WO 02/081863 | 10/2002 |
| WO | WO 02/086287 | 10/2002 |
| WO | WO 03/074836 | 9/2003 |
| WO | WO 03/087525 | 10/2003 |

OTHER PUBLICATIONS

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, February (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004 (WEAT/0360).

U.S. Appl. No. 10/832,804, filed Apr. 27, 2004 (WEAT/0383.P1).

U.S. Appl. No. 10/795,214, filed Mar. 5, 2004 (WEAT/0373).

U.S. Appl. No. 10/794,795, filed Mar. 5, 2004 (WEAT/0357).

U.S. Appl. No. 10/775,048, filed Feb. 9, 2004 (WEAT/0359).

U.S. Appl. No. 10/772,217, filed Mar. 5, 2004 (WEAT/0360.P1).

U.S. Appl. No. 10/788,976, filed Feb. 27, 2004 (WEAT/0372).

U.S. Appl. No. 10/794,797, filed Mar. 5, 2004 (WEAT/0371).

U.S. Appl. No. 10/767,322, filed Jan. 29, 2004 (WEAT/0343).

U.S. Appl. No. 10/795,129, filed Mar. 5, 2004 (WEAT/0366).

U.S. Appl. No. 10/794,790, filed Mar. 5, 2004 (WEAT/0329).

U.S. Appl. No. 10/162,302, filed Jun. 4, 2004 (WEAT/0410).

Rotary Steerable Technology—Technology Gains Momentum, Oil & Gas Journal, Dec. 28, 1998.

Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093, filed Jul. 11, 2003, Boyle.
U.S. Appl. No. 10/189,570, filed Apr. 6, 2004, Schwartz et al.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling for Depleted Resevoirs, IADC/SPE Paper 39399, IADC/SPE Drilling Conference, Mar. 3-6, 1998, pp 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, April 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology, " SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-6.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.

McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
PCT Search Report, Internation Application No. PCT/US2004/006754, dated Aug. 4, 2004.
Detlef Hahn, Friedhelm, Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pps. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.

* cited by examiner

ADJUSTABLE ROTATING GUIDES FOR SPIDER OR ELEVATOR

CROSS-REFERENCE TO RELATED APPLICATIONS

This application is a continuation-in-part of co-pending U.S. patent application Ser. No. 10/207,542 filed Jul. 29, 2002, which is herein incorporated by reference in its entirety. This application also claims benefit of U.S. Provisional Patent Application Ser. No. 60/452,154 filed on Mar. 5, 2003, which is incorporated herein by reference in its entirety.

BACKGROUND OF THE INVENTION

1. Field of the Invention

Embodiments of the present invention generally relate to an apparatus and method for handling tubulars and drilling with tubulars to form a wellbore. More particularly, embodiments of the present invention relate to drilling with casing. Even more particularly, embodiments of the present invention relate to a gripping apparatus for supporting casing for use in a drilling with casing operation.

2. Description of the Related Art

In conventional well completion operations, a wellbore is formed to access hydrocarbon-bearing formations by the use of drilling. In drilling operations, a drilling rig is disposed above the subterranean formation where the access will be formed. A rig floor of the drilling rig is the surface from which casing strings, cutting structures, and other supplies are lowered to form a subterranean wellbore lined with casing. A hole is formed in a portion of the rig floor above the desired location of the wellbore. The axis that runs through the center of the hole formed in the rig floor is well center.

Drilling is accomplished by utilizing a drill bit that is mounted on the end of a drill support member, commonly known as a drill string. To drill within the wellbore to a predetermined depth, the drill string is often rotated by a top drive or rotary table on the drilling rig. After drilling to a predetermined depth, the drill string and drill bit are removed and a section of casing is lowered into the wellbore.

Often, it is necessary to conduct a pipe handling operation to connect sections of casing to form a casing string or to connect sections of tubular to form a tubular string. The pipe handling operation to connect sections of casing may be used to produce a casing string which extends to the drilled depth. Pipe handling operations require the connection of casing sections to one another to line the wellbore with casing. To threadedly connect the casing strings, each casing section may be retrieved from its original location (e.g., a rack beside the drilling platform) and suspended above well center so that each casing section is in line with the casing section previously disposed within the wellbore. The threaded connection is made up by a device which imparts torque to one casing section relative to the other, such as a power tong or a top drive. The casing string formed of the two casing sections is then lowered into the previously drilled wellbore.

It is common to employ more than one string of casing in a wellbore. In this respect, the well is drilled to a first designated depth with a drill bit on a drill string. The drill string is removed. Sections of casing are connected to one another and lowered into the wellbore using the pipe handling operation described above to form a first string of casing longitudinally fixed in the drilled out portion of the wellbore. Next, the well is drilled to a second designated depth through the first casing string, and a second, smaller diameter string of casing comprising casing sections is hung off of the first string of casing. This process is typically repeated with additional casing strings until the well has been drilled to total depth. In this manner, wellbores are typically formed with two or more strings of casing.

The handling of casing strings has traditionally been performed with the aid of a spider along with an elevator. Spiders and elevators are used to grip the casing strings at various stages of a pipe handling operation. Typically, spiders include a plurality of slips circumferentially surrounding the exterior of the casing string. The slips are housed in what is commonly referred to as a "bowl". The bowl is regarded to be the surfaces on the inner bore of the spider. The inner sides of the slips usually carry teeth formed on hard metal dies for engaging the pipe string. The exterior surface of the slips and the interior surface of the bowl have opposing engaging surfaces which are inclined and downwardly converging. The inclined surfaces allow the slip to move vertically and radially relative to the bowl. In effect, the inclined surfaces serve as a camming surface for engaging the slip with the casing string. Thus, when the weight of the casing string is transferred to the slips, the slips will move downwardly with respect to the bowl. As the slips move downward along the inclined surfaces, the inclined surfaces urge the slips to move radially inward to engage the casing string. In this respect, this feature of the spider is referred to as "self tightening." Further, the slips are designed to prohibit release of the casing string until the casing string load is supported by another means such as the elevator.

In the making up or breaking out of casing string and/or tubular string connections, the spider is typically used for securing the casing string or tubular string in the wellbore. Additionally, an elevator suspended from a rig hook is used in tandem with the spider. The elevator may include a self-tightening feature similar to the one in the spider. In operation, the spider remains stationary while securing the casing string in the wellbore. The elevator positions a casing string section above the casing string for connection. After completing the connection, the elevator pulls up on the casing string to release the casing string from the slips of the spider. Freed from the spider, the elevator may now lower the casing string into the wellbore. Before the casing string is released from the elevator, the spider is allowed to engage the pipe string again to support the casing string. After the load of the casing string is switched back to the spider, the elevator may release the casing string and continue the makeup process.

As an alternative to the conventional method, drilling with casing is a method often used to place casing strings within the wellbore. This method involves attaching a cutting structure in the form of a drill bit to the lower end of the same string of casing which will line the wellbore. Drilling with casing is often the preferred method of well completion because only one run-in of the working string into the wellbore is necessary to form and line the wellbore for each casing string.

Drilling with casing is typically accomplished using a top drive powered by a motor because the top drive is capable of performing both functions of imparting torque to the casing string to make up the connection between casing strings during pipe handling operations and drilling the casing string into the formation. FIG. 1 shows two exemplary gripping apparatuses 100, 200 used in a typical drilling with casing operation. Connected to a drilling rig 105 is a traveling block 115 suspended by wires 150 from draw works 120. A top drive 110 with an elevator 200 connected thereto is suspended from the traveling block 115. The elevator 200 typically is connected to the top drive 110 by bails 125. A motor 140 is the part of the top drive 110 used to rotate a first and second casing string 210, 130 when drilling with casing or to rotate the second casing string 130 when connecting the second casing string 130 to the first casing string 210 which has been previously located within a wellbore 180. Located within a rig floor 135 of the drilling rig 105 is a rotary table 145 into which the spider 100 can be placed. The spider 100 and the elevator 200 are both used to grippingly and rotationally support casing strings 210, 130 axially at various stages of a typical operation; therefore, both the spider 100 and the elevator 200 are deemed "gripping apparatuses" for purposes of the present invention.

Current spiders and elevators useable in drilling with casing operations are capable of either being actuated to grippingly engage the casing string to prevent rotational or axial movement of the casing string or, in the alternative, of being unactuated to release the casing string completely to allow axial and rotational movement of the casing string while the casing string is drilled into the formation. Because only these two positions are possible with current gripping apparatuses, problems occur when using the gripping apparatuses while drilling with casing. When performing a drilling with casing operation with the current spiders or elevators in the unactuated position, the casing string is not centered within the wellbore while drilling because the casing string is not supported along its diameter and thus is free to move within the wellbore while drilling. Furthermore, because the casing string is loose inside the gripping apparatus, the slips of the gripping apparatus often contact the outer diameter of the casing string being rotated while drilling and can cause damage to the casing string. When the slips contact the outer diameter of the casing string, damage may also result to the slips. Additionally, the rotational movement is hindered in the current gripping apparatus by any contact of the casing string with parts of the gripping apparatus.

There is therefore a need for a gripping apparatus useful during a drilling with casing operation. There is a further need for a gripping apparatus which is capable of accommodating more than one pipe size so that the casing is centered on the well center while drilling with casing. There is an even further need for a gripping apparatus which allows the casing string to freely rotate while preventing damage to the casing and positioning the casing over the well center during a drilling with casing operation.

SUMMARY OF THE INVENTION

Embodiments of the present invention generally provide a gripping apparatus for supporting a casing. In one aspect, the apparatus includes a housing having a longitudinal opening extending therethrough and one or more gripping members which, when the gripping apparatus is actuated, move radially toward the casing to contact the casing. In another aspect, the apparatus may include one or more guides to facilitate movement of the casing within the housing of the gripping apparatus. The one or more guides may be positioned around the opening in a manner capable of centering the pipe. The one or more guides may be adjustable radially within the opening to accommodate different sizes of casing.

In another embodiment, the one or more guides may comprise one or more rolling members in the vertical position, wherein the one or more rolling members are positioned so that an axis of the rolling members is parallel to an axis of the longitudinal opening so that the rolling members are capable of imparting a rolling motion along the inner diameter of the casing while the casing is rotated. The rolling members may be adjustable between the parallel position and a position wherein the axis of the rolling members is perpendicular to the axis of the casing. In another aspect, the rolling members may be adjustable to a position between the parallel position and the perpendicular position.

Providing guides with rolling members in the vertical position allows the casing to be rotated to drill with the casing without contacting the one or more gripping members with the casing. Furthermore, the guides of the present invention allow the casing to be centered within the gripping apparatus and the wellbore for the drilling with casing operation or the casing lowering operation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
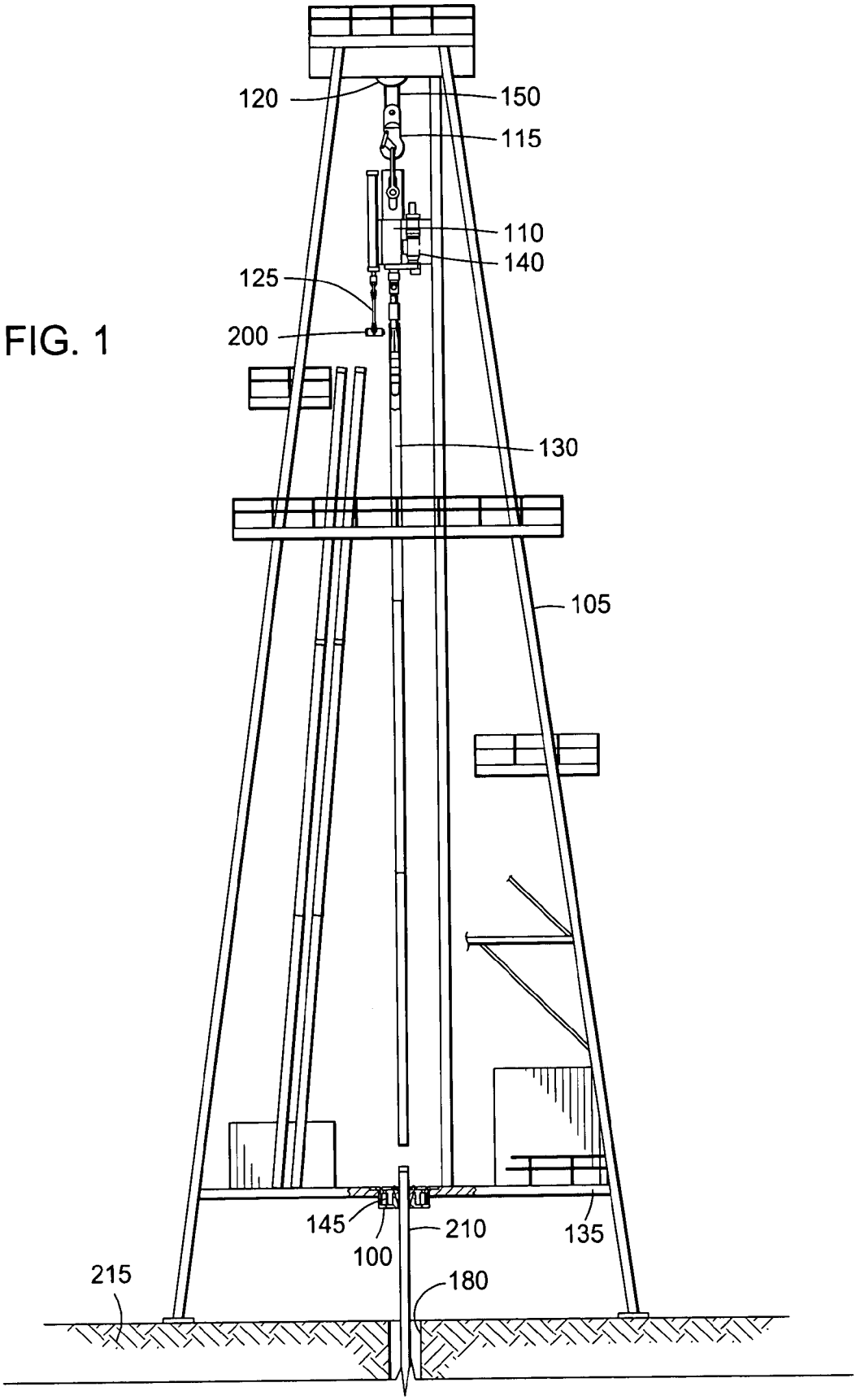
FIG. 1 is a side view of a typical drilling rig with a top drive, spider, and elevator.
Figure 2:
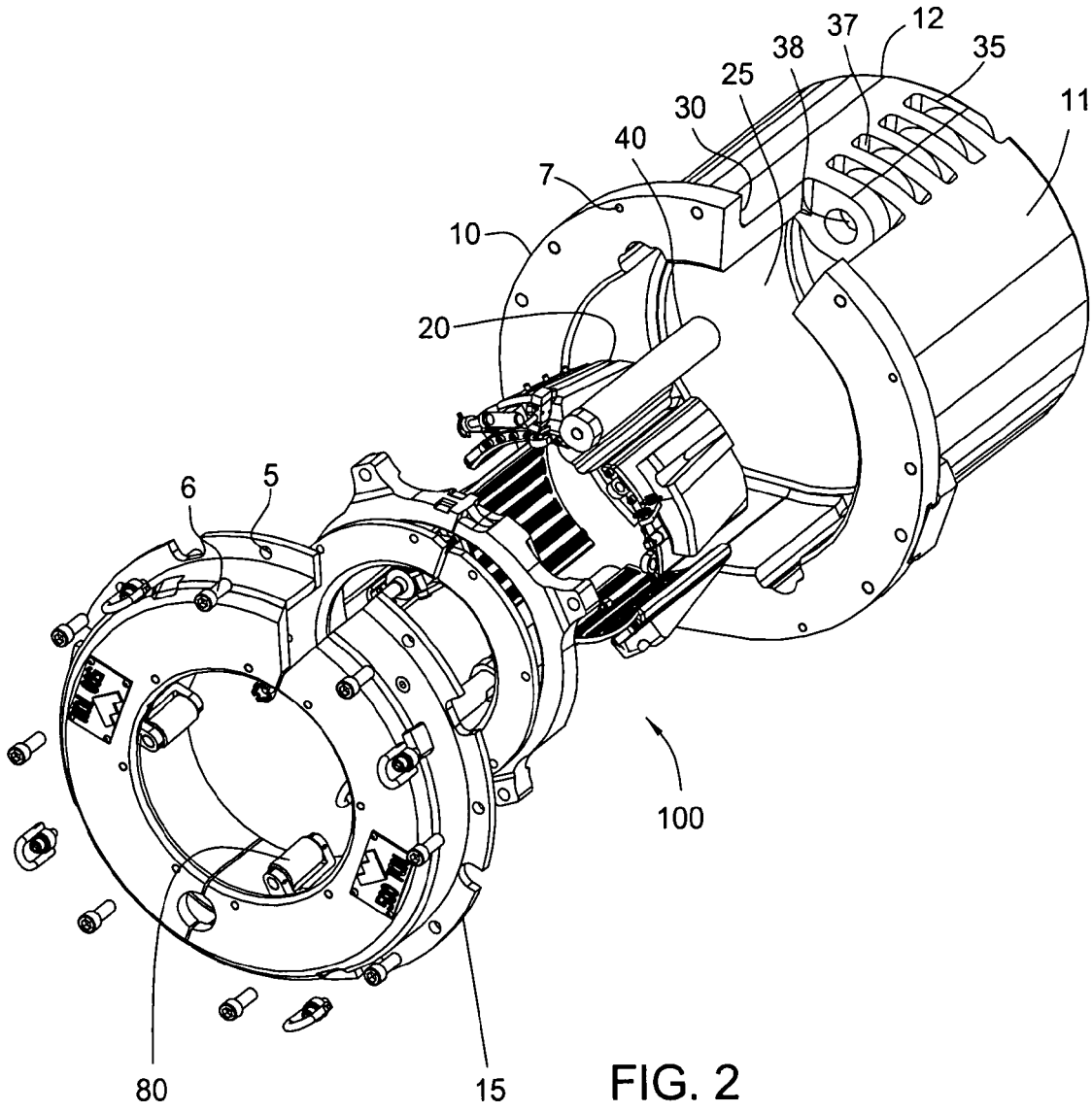
FIG. 2 is a downward, side view of a gripping apparatus according to the present invention.

FIG. 2 shows an exemplary gripping apparatus 100 which can be used with guides 80 of the present invention. It is understood that the guides 80 are useable with any gripping apparatus 100, 200, including but not limited to elevators and spiders, which are used in a drilling with casing operation, a pipe handling operation, or a conventional drilling operation. As shown in FIG. 2, the gripping apparatus 100 is a flush mounted spider disposable within a rotary table 145, as shown in FIG. 1, although the following description may also be applied to an elevator 200. The gripping apparatus 100 has a body 10 with any number of body sections 11, 12, preferably two body sections 11, 12 as shown, for housing one or more gripping members 20 and a cover assembly 15 for the body 10. A flange 30 may be formed on an upper portion of the body sections 11, 12 for connection to the cover assembly 15.

The body 10 of the gripping apparatus 100 may be formed by pivotally coupling two body sections 11, 12 with one or more connectors 35. Connectors 35 may be used to couple the two body sections 11, 12 together upon placement in the rotary table 145. The connectors 35 may be hinges disposed on both sides of each body section 11, 12. Alternatively, the body sections 11, 12 may be hinged on one side and selectively locked together on the other side. A gap 37 exists between each connector 35 on body section 11 for mating with its respective connector 35 formed on body section 12. Likewise, a gap 37 exists between each connector 35 on body section 12 for mating with its respective connector 35 formed on body section 11. A hole 38 is formed through each connector 35 to accommodate at least one connecting member such as a pin 40. The holes 38 in the connectors 35 are substantially aligned so that the pin 40 may be disposed through the holes 38 to secure the two body sections 11, 12 together to form the body 10.

A bowl 25 extends vertically through a lower portion of the body 10 to house the gripping members 20. The bowl 25 is a progressive recess along an inner wall of the body sections 11, 12. The progressive recess of the bowl 25 creates an inclined portion of the inner wall, which mates with the back of the gripping members 20. The gripping members 20 preferably comprise a slip assembly comprised of slips for engaging the casing string 210 and/or 130 upon activation.

The body 10 of the gripping apparatus 100 is covered by the cover assembly 15, which may also have two or more separate sections placed above the respective body sections 11, 12. If the cover assembly 15 is sectioned in this way, the cover assembly 15 may open and close along with the body 10 of the gripping apparatus 100. The sections of the cover assembly 15 form a hole whose center generally coincides with the center of the body 10. The cover assembly 15 has holes 5 which extend therethrough to mate with holes 7 through the body 10. One or more connecting members such as pins 6 are placed through the holes 5 and the holes 7 to rotationally and axially fix the cover assembly 15 relative to the body 10.

Figure 3:
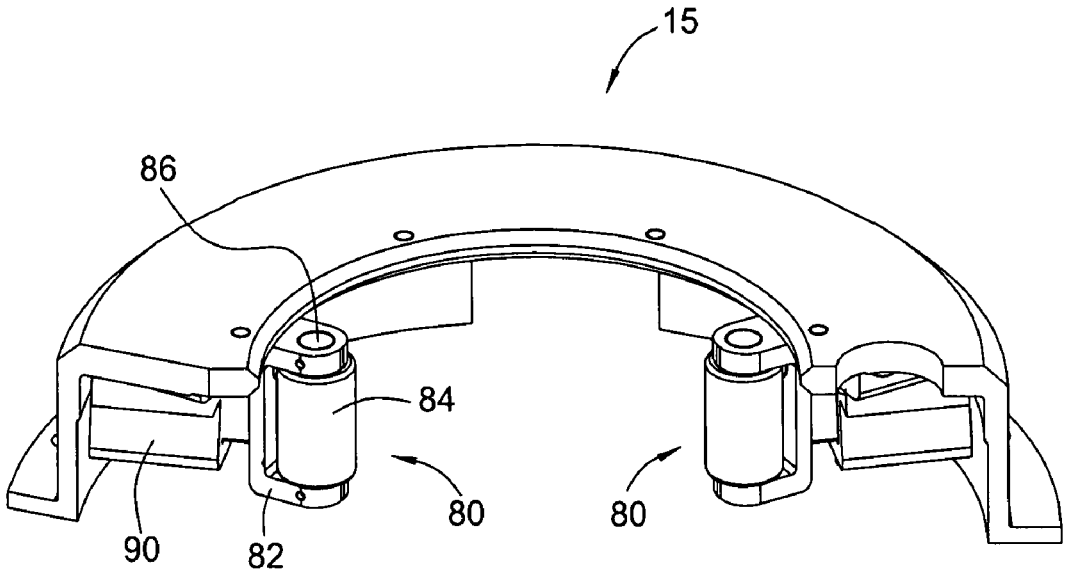
FIG. 3 is a sectional view of the guides located within the gripping apparatus of FIG. 2.

FIG. 3 shows one section of the cover assembly 15 of the gripping apparatus 100 of FIG. 2. For each section of the cover assembly 15, there is at least one guide 80. Preferably, the gripping apparatus 100 has three guides 80 radially spaced substantially equally apart along the center of the cover assembly 15. Preferably, the guides 80 are attached below the top of the cover assembly 15.

Figure 4:
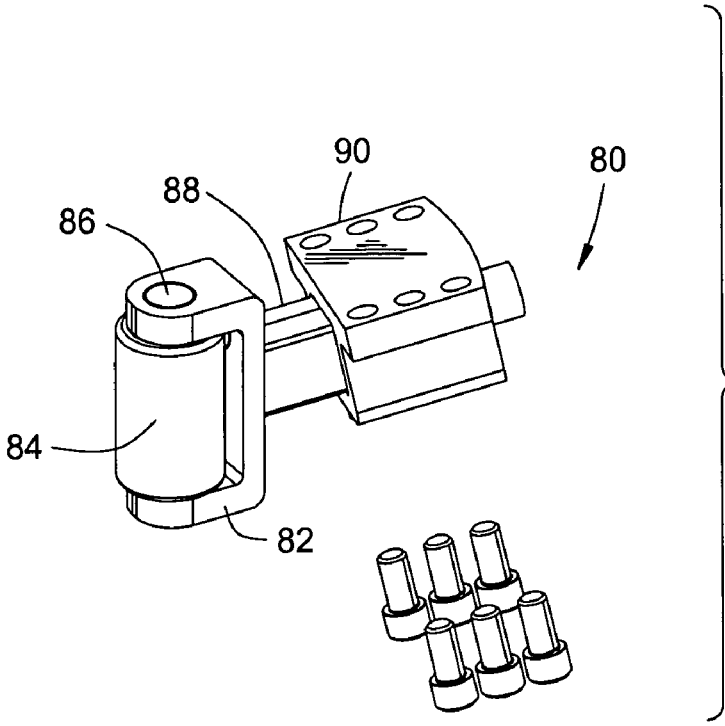
FIG. 4 is a sectional view of the guides of FIG. 2.

FIGS. 3 and 4 depict the guides 80, which preferably comprise rollers 84 and are oriented at least substantially vertically with respect to the cover assembly 15 and generally parallel to the axis of the wellbore 180 (as shown in FIG. 1), so that their rolling motion is generally parallel to the diameter of the cover assembly 15. A connecting member such as a pin 86 extends from each of the rollers 84 so that each end of the pin 86 resides within a clevis 82 disposed therearound.

Preferably, the guides 80 are adjustable radially inward and outward from the cover assembly 15 to accommodate various casing string 210, 130 sizes. To this end, the clevis 82 may include a shaft 88 insertable into a mounting device 90 for attachment to the cover assembly 15. The shaft 88 may be adjustable within the mounting device 90 to radially extend or contract the rollers 80 with respect to the mounting device 90 so that the gripping apparatus 100 is useable with various casing string sizes (diameters). The shaft 88 may be adjusted to extend or retract the rollers 84 manually, hydraulically, by a fluid-operated piston/cylinder assembly, by means of a solenoid arrangement, or any other suitable mechanism. Further, such adjustment mechanism may be integrated with a fluidic or electric control system to facilitate remote control and position monitoring. The guides 80 may be adjusted radially inward or outward so that each guide is the same distance from the cover assembly 15. In the alternative, if the three guides 80 are used (or at least multiple guides 80), the guides 80 may be adjusted radially inward or outward so that one of the guides 80 is at a distance from the cover assembly 15 greater than the distance between the two remaining guides 80 and the cover assembly 15. The guides 80 may be adjusted to exist at different distances from the cover assembly 15, for example, to accommodate a casing string which is to be inserted into the gripping apparatus 100 which is not in line with the central axis of the gripping apparatus 100.

In another aspect of the present invention, the guides 80 may be adjustable between the vertical position with respect to the cover assembly 15, as shown in FIGS. 2–4, and the horizontal position with respect to the cover assembly 15 wherein the rolling motion of the rollers is along the length of an inserted casing string 210, 130. A pivoting mechanism may connect the shaft 88 to the spider 100 so that the rollers 84 along with the shaft 88 are pivotable between the vertical position and the horizontal position with respect to the gripping apparatus 100, according to the operation which is conducted. The rollers 84 may also be pivoted to a position in between the vertical and the horizontal position, so that the rollers 84 are at an angle with respect to the gripping apparatus 100. The angled position may be desirable while rotating the casing string 210, 130 while simultaneously lowering the casing string 210, 130 within the gripping apparatus 100 so that the rollers 84 accommodate the movement of the casing string 210, 130 and roll more easily along the outer diameter of the casing string 210, 130.

In operation, the spider 100 is flush mounted in the rotary table 145, as shown in FIG. 1. The orientation of the guides 80 is adjusted to accommodate the incoming first casing string 210 axially and rotationally. For example, if the operation performed involves merely lowering the first casing string 210 into the wellbore 180 without drilling, the rollers 84 may be oriented horizontally with the axis of the rollers 84 being perpendicular to the axis of the wellbore 180 so that their rolling motion is along the length of the casing string 210 as it is inserted into the wellbore 180. Orienting the rollers 84 horizontally permits axial longitudinal movement of the first casing string 210 within the wellbore 180, while essentially preventing rotational movement of the first casing string 210 within the wellbore 180. In the alternative, if the operation performed involves drilling with the first casing string 210, the guides 80 may be oriented vertically with the axis of the rollers 84 parallel to the axis of the wellbore 180 so that their rolling motion is along the diameter of the first casing string 210 as it is rotated. Rollers 84 oriented in this fashion permit the first casing string 210 to rotate within the wellbore 180 while the first casing string 210 is simultaneously being lowered into the wellbore 180. Both positions of the rollers 84 facilitate movement of the first casing string 210 within the body 10 and aid in centering the first casing string 210 within the gripping assembly 100. The rollers 84 may also be oriented to exist between the horizontal and vertical position.

The rollers 84 may also be adjusted radially outward or inward from the gripping apparatus 100 to accommodate the diameter of the first casing string 210. The shaft 88 of the clevis 82 moves through the mounting device 90 to adjust the rollers 84 radially. The shaft 88 may be moved through the mounting device 90 manually or by fluid pressure contacting an end of the shaft 88 opposite the clevis 82.

After any adjustments to the gripping apparatus 100 are accomplished, the first casing string 210 may be retrieved from its original location, such as a rack (not shown), and if necessary through a v-door (not shown) of the drilling rig 105 by the elevator 200. The elevator 200 comprises a clamp (not shown) with one or more gripping members such as slips (not shown) which grippingly engage the first casing string 210, preferably below a coupling (not shown) threaded onto the upper portion of the first casing string 210. It is contemplated that the first casing string 210 may alternatively be grippingly engaged at any other location on the first casing string 210 than the coupling. The first casing string 210 may comprise one section of casing or may comprise any number of casing sections connected, preferably threaded together.

After the first casing string 210 is connected to a lower end of the top drive 110, the first casing string 210 is lowered into the wellbore 180 while simultaneously rotating. The first casing string 210, which preferably has an earth removal member such as a cutting structure (not shown) (preferably a drill bit) disposed at its lower end to drill the wellbore 180, is lowered into the wellbore 180 by cables 150 traveling through the draw works 120. Because the gripping members 20 are initially unactuated and in a retracted position within the bowl 25, the first casing string 210 is allowed to move downward through the spider 100. At the same time that the first casing string 210 is moving downward, the first casing string 210 may be rotated by the motor 140 of the top drive 110 so that the cutting structure located at the lower end of the first casing string 210 drills into a formation 215 below the drilling rig 105 to form the wellbore 180. While the first casing string 210 is rotating, the draw works 120, cables 150, traveling block 115, top drive 110, and elevator 200 resist the torque imparted by the top drive 110, and therefore are rotationally fixed. As the first casing string 210 is drilled into the formation 215 by the top drive 110, the gripping members 20 of the spider 100 remain unactuated so that they do not engage the outer diameter of the first casing string 210. As such, the first casing string 210 is allowed to move downward to form the wellbore 180. Furthermore, because the rollers 84 are previously oriented vertically, the first casing string 210 is allowed to rotate with respect to the wellbore 180 as well as with respect to the body 10 of the spider 100, so that a drilling with casing operation may be performed through the spider 100.

After the first casing string 210 is drilled into the formation 215 to the desired depth so that an upper portion of the first casing string 210 still exists above the rig floor 135, the spider 100 is activated so that the gripping members 20 engage the upper portion of the first casing string 210 and prevent the first casing string 210 from further downward movement into the wellbore 180. The gripping members 20 are activated to move along the incline of the bowl 25 to grip the first casing string 210. The gripping members 20 may be urged along the incline of the bowl 25 by a piston and cylinder assembly, as shown in co-pending U.S. application Ser. No. 10/207,542, filed Jul. 29, 2002 (incorporated by reference above), or, in the alternative, may be moved along the incline by the weight of the first casing string 210 upon the gripping members 20. In either instance, the incline of the bowl 25 causes the gripping members 20 to move radially toward the outer diameter of the first casing string 210 to contact the first casing string 210 and hinder further downward movement of the first casing string 210 within the wellbore 180.

After the spider 100 stops the first casing string 210 from further downward movement within the wellbore 180, the top drive 110 and elevator 200 are disengaged from the first casing string 210. The elevator 200 retrieves a second casing string 130 from its original location, such as from the rack (not shown), and connects the second casing string 130 to the top drive 110. The second casing string 130 is lowered toward the wellbore 180 substantially in line with the first casing string 210 with respect to well center to mate with the first casing string 210. Then a makeup operation is performed, and the top drive 110 may be activated so that the motor 140 rotates the second casing string 130 to threadedly connect the second casing string 130 to the first casing string 210.

The spider 100 is then unactuated again to release the gripping members 20 from the first casing string 210. Releasing the gripping members 20 causes the gripping members 20 to move radially away from the first casing string 210. The gripping members 20 may be released by actuating the piston and cylinder assembly according to the above-mentioned co-pending application. In the alternative, the gripping members 20 may be released by pulling up on the casing 130, by using an elevator for example.

Because the first casing string 210 and the second casing string 130 are now threadedly connected to one another, the elevator 200 and connection to the top drive 110 hold the entire casing string 210, 130 above the wellbore 180. The top drive 110 may again impart rotation to the casing string 210, 130 while the casing string 210, 130 is simultaneously lowered, so that the drill bit (not shown) at the lower end of the first casing string 210 drills to a second depth within the formation 215. The rollers 84 are adjusted radially outward or inward to accommodate the diameter of the second casing string 140 when the second casing string 140 reaches the spider 100. The process as described above is then repeated until the desired number of casing strings is disposed within the wellbore 180 to reach the desired depth within the formation 215.

The above description of embodiments of the present invention contemplates the spider 100 being flush mounted within the rig floor 135. Alternative embodiments include the spider 100 being mounted or located above or on the rig floor 135, as with conventional spiders, or mounted or located below the rig floor 135.

Moreover, above-described embodiments include rotating the entire casing string while drilling the casing into the formation. Other embodiments of the present invention involve rotating only a portion of the casing string, for example the earth removal member (preferably a drill bit) by a mud motor or other torque-conveying device. Yet further embodiments of the present invention involve merely lowering the casing string into the formation to form a wellbore while circulating drilling fluid out from the casing string ("jetting") without rotation of any portion of the casing string. Any combination of rotation of the casing string, rotation of a portion of the casing string, and/or jetting may be utilized in embodiments of the present invention.

Although the above discussion of embodiments of the present invention describes the spider 100 in terms of drilling with casing, the spider 100 may also be used in casing handling operations to support any type of tubular body during any wellbore operation. Specifically, the spider 100 may be utilized to support a tubular when making up and/or breaking out threadable connections between tubulars and/or lowering tubulars into the wellbore. Tubulars usable with the spider 100 of the present invention include but are not limited to drill pipe, liner, tubing, and slotted tubulars. Additionally, the spider 100 described above may be used for running casing into a previously-formed wellbore, drilling with casing, running one or more tubulars into the wellbore, forming a tubular string (e.g., by threadedly connecting tubulars), and/or connecting casing sections (preferably by threadable connection) to one another.

While the foregoing is directed to embodiments of the present invention, other and further embodiments of the invention may be devised without departing from the basic scope thereof, and the scope thereof is determined by the claims that follow.

What is claimed is:

1. A gripping apparatus for supporting a tubular comprising:

a housing having a bore extending therethrough;

one or more gripping members moveable radially within the bore to grippingly engage the tubular; and one or more guide rolling members to facilitate movement of the tubular within the housing, wherein the one or more guide rolling members are radially movable into engagement with the tubular.

2. The gripping apparatus of claim 1, wherein the one or more guide rolling members facilitate rotational movement of the tubular within the housing.

3. The gripping apparatus of claim 1, wherein the one or more guide rolling members are positioned in a manner capable of centering the tubular.

4. The gripping apparatus of claim 1, wherein the one or more guide rolling members are adjustable to accommodate tubulars of different sizes.

5. The gripping apparatus of claim 1, wherein the one or more guide rolling members are oriented radially inward toward the tubular with respect to the housing.

6. The gripping apparatus of claim 1, wherein the one or more guide rolling members are extendable further radially inward toward the tubular than the one or more gripping members.

7. The gripping apparatus of claim 1, wherein the one or more guide rolling members comprises:

a clevis having a shaft at one end;

a pin for coupling a roller to the clevis; and a mounting assembly, wherein the shaft is adjustable within the mounting assembly.

8. The gripping apparatus of claim 7, wherein the shaft is adjustable within the mounting assembly by fluid pressure.

9. The gripping apparatus of claim 7, wherein the clevis is disposed parallel to the rotational axis of the tubular.

10. The gripping apparatus of claim 1, wherein the one or more guide rolling members are rollable along the outer diameter of the tubular.

11. The gripping apparatus of claim 1, wherein an axis of the one or more guide rolling members is substantially parallel to an axis of the housing.

12. The gripping apparatus of claim 1, wherein an axis of the one or more guide rolling members is substantially parallel to an axis of the tubular.

13. The gripping apparatus of claim 1, wherein the one or more guide rolling members are adjustable from a first position wherein an axis of the one or more guide rolling members is substantially parallel to an axis of the tubular to a second position wherein the axis of the one or more guide rolling members is not substantially parallel to the axis of the tubular.

14. The gripping apparatus of claim 1, wherein an axis of the one or more guide rolling members is approximately equidistant from an axis of the housing.

15. The gripping apparatus of claim 1, wherein the tubular is casing.

16. A method of drilling with casing into a formation, comprising:

providing a gripping apparatus having an opening therethrough and one or more gripping members disposed therein, the gripping apparatus comprising one or more guide rolling members disposed within the opening;

adjusting the one or more guide rolling members radially within the opening;

lowering a first casing having an earth removal member operatively attached to its lower end into the formation while rotating the first casing; and contacting the first casing with the one or more guide rolling members while lowering the first casing.

17. The method of claim 16, wherein lowering the first casing comprises rotating the first casing.

18. The method of claim 16, wherein adjusting the one or more guide rolling members radially within the opening comprises adjusting the axis of the one or more guide rolling members radially to accommodate misalignment between an axis of the first casing and an axis of the opening.

19. The method of claim 16, further comprising:

drilling the first casing to a desired depth within the formation; and activating the gripping apparatus to cause the one or more gripping members to grippingly engage an outer diameter of the first casing.

20. The method of claim 16, further comprising:

drilling the first casing to a desired depth within the formation; and activating the gripping apparatus to inhibit axial movement of the first casing.

21. The method of claim 20, further comprising:

connecting a second casing to the first casing;

lowering the second casing into the formation while rotating the second casing; and contacting the second casing with the one or guide rolling members while rotating the second casing.

22. The method of claim 16, wherein the one or more guide rolling members roll along the outer diameter of the first casing while the first casing is rotating.

23. The method of claim 16, wherein adjusting the one or more guide rolling members further comprises pivoting the one or more guide rolling members from rollable along an outer diameter of the first casing while the first casing is rotating to rollable along the outer diameter of the first casing while the first casing is moving axially within the gripping apparatus.

24. The method of claim 16, wherein adjusting the one or more guide rolling members further comprises pivoting the one or more guide rolling members from a position wherein the axis of the one or more guide rolling members is parallel to the axis of the first casing to a position wherein the axis of the one or more guide rolling members is not parallel to the axis of the first casing.

25. The method of claim 16, further comprising contacting the first casing with the one or more guide rolling members while lowering the first casing.

26. The method of claim 25, wherein the rotating and lowering the first casing is simultaneous.

27. The method of claim 16, wherein extending the one or more guide rolling members comprises calculating the extension of the one or more guide rolling members necessary to contact an outer diameter of the first casing string.

28. The method of claim 16, wherein the first casing is lowered relative to the one or more guide rolling members.

29. The method of claim 16, wherein adjusting the one or more rolling members comprises moving the one or more rolling members radially inward into engagement with the first casing.

30. A gripping apparatus for supporting a tubular comprising:

a housing having a bore extending therethrough;

one or more gripping members moveable radially within the bore to grippingly engage the tubular; and one or more guide rolling members to facilitate movement of the tubular within the housing, wherein the one or more guide rolling members are adjustable from a first position wherein an axis of the one or more guide rolling members is substantially parallel to an axis of the tubular to a second position wherein the axis of the one or more guide rolling members is not substantially parallel to the axis of the tubular.

31. A gripping apparatus for supporting a tubular comprising:

a housing having a bore extending therethrough;

one or more gripping members moveable radially within the bore to grippingly engage the tubular; and one or more guide rolling members to facilitate movement of the tubular within the housing, wherein the one or more guide rolling members are oriented radially inward toward the tubular with respect to the housing.

32. A gripping apparatus for supporting a tubular comprising:

a housing having a bore extending therethrough;

one or more gripping members moveable radially within the bore to grippingly engage the tubular; and one or more guide rolling members to facilitate movement of the tubular within the housing, wherein the one or more guide rolling members are extendable further radially inward toward the tubular than the one or more gripping members.

* * * * *